US006543203B2

(12) United States Patent
Thompson et al.

(10) Patent No.: US 6,543,203 B2
(45) Date of Patent: Apr. 8, 2003

(54) MICROPLATE LIDDER/DELIDDER

(75) Inventors: Stanley O. Thompson, New Boston, NH (US); David E. Roche, Nashua, NH (US)

(73) Assignee: TekCel, Inc., Hopkinton, MA (US)

( * ) Notice: Subject to any disclaimer, the term of this patent is extended or adjusted under 35 U.S.C. 154(b) by 29 days.

(21) Appl. No.: 09/771,106

(22) Filed: Jan. 26, 2001

(65) Prior Publication Data

US 2002/0100251 A1 Aug. 1, 2002

(51) Int. Cl.[7] ..... B65B 7/28

(52) U.S. Cl. ..... 53/329; 53/290; 53/381.4; 53/390

(58) Field of Search ..... 53/290, 305, 329, 53/329.3, 381.4, 390

(56) References Cited

U.S. PATENT DOCUMENTS

| | | | | | |
|---|---|---|---|---|---|
| 3,392,506 | A | * | 7/1968 | Haines | 53/381.4 |
| 3,449,890 | A | * | 6/1969 | Sarutani | 53/329.3 |
| 4,096,965 | A | | 6/1978 | Lessnig et al. | |
| 4,226,072 | A | * | 10/1980 | Balzer | 53/329.3 |
| 4,466,767 | A | * | 8/1984 | Meschi | 53/381.4 |
| 5,048,259 | A | * | 9/1991 | Cox | 53/381.4 |
| 5,273,718 | A | | 12/1993 | Skold et al. | |
| 5,604,130 | A | | 2/1997 | Warner et al. | |
| 5,657,617 | A | * | 8/1997 | Allen | 53/381.4 |
| 5,665,247 | A | | 9/1997 | Valus et al. | |
| 5,842,321 | A | * | 12/1998 | Jones | 53/281 |
| 5,851,346 | A | | 12/1998 | Hitch | |
| 5,851,492 | A | | 12/1998 | Blattner | |
| 5,894,711 | A | * | 4/1999 | Davidson | 53/381.4 |
| 6,099,230 | A | | 8/2000 | Hitch | |
| 6,254,833 | B1 | | 7/2001 | Shumate et al. | |
| 6,394,299 | B1 | | 5/2002 | Hupp | |
| 6,408,595 | B1 | * | 6/2002 | Friedman | 53/329 |

FOREIGN PATENT DOCUMENTS

| | | |
|---|---|---|
| WO | WO 92/02303 A1 | 2/1992 |
| WO | WO 01/85550 A2 | 11/2001 |

OTHER PUBLICATIONS

PCT Notification of Transmittal of the International Search Report or the Declaration, Form PCT/ISA/220 (Apr. 2002).
PCT International Search Report, Form PCT/ISA/210 (Jul. 1998).
U.S. patent application Publication, Pub. No.: US 2001/0007642 A1, Pub. Date: Jul. 12, 2001 by Feiglin for a Sealing Apparatus for Use with Microplates.
U.S. patent application Publication, Pub. No.: US 2002/0021986 A1, Pub. Date: Feb. 21, 2002 by McCall et al. for a Microplate Sealer.
Hall et al., Publication No. US 2002/0039545 A1, Apr. 4, 2002.

* cited by examiner

*Primary Examiner*—John Sipos
(74) *Attorney, Agent, or Firm*—Cesari and McKenna, LLP

(57) ABSTRACT

A machine for engaging/disengaging a cover with a microplate. The machine is manually operated by hand crank. By turning the crank in one direction, a user may engage a cover with microplate. Turning the crank in the opposite direction disengages a cover from a microplate. User safety is enhanced by the machine which isolates the user from direct contact with potentially hazardous material and sharp edged covers.

1 Claim, 7 Drawing Sheets

MICROPLATE LIDDER/DELIDDER

CROSS REFERENCE TO RELATED APPLICATION

This application is related to application Ser. No. 09/740,624, filed Dec. 19, 2000 and assigned to the assignee of the present invention, which is hereby incorporated by reference.

BACKGROUND OF THE INVENTION

1. Field of the Invention

The invention relates generally to the field of microplates and, more specifically, to a machine for securing a lid to or removing a lid from a microplate.

2. Background Information

Microplates are commonly used in a variety of test procedures. During such procedures, it may be desirable or necessary to cover or seal the wells contained in the microplates in order to produce appropriate test conditions, prevent cross-contamination among wells, prevent sample leakage during transportation or storage, or prevent human exposure to hazardous samples. In addition, some test procedures, including high throughput screening, may require a large number (e.g., on the order of hundreds or thousands) of microplates to be handled rapidly. In such an environment, it is essential that the process of engaging or disengaging the microplate's cover does not interfere with or unduly reduce the throughput of the system.

Conventional microplate covers suffer from several significant disadvantages. First, most covers are not adapted to work with robotic or other automatic handling machines, which effectively forces users to engage or disengage the covers by hand. Such manual handling is commercially unacceptable in applications such as high throughput screening. Second, manually engaging/disengaging the covers presents a safety hazard due to possible contact with hazardous samples or risk of injury from sharp-edged covers which typically require considerable force to engage or disengage. Third, repeated manual handling may also increase the risk of damage to either the microplate or cover.

SUMMARY OF THE INVENTION

In brief summary, the present invention provides a machine for engaging a microplate cover (lid) with or removing the cover from a microplate. The machine, sometimes referred to herein as a lidder/delidder, is simple to operate, requiring only the rotation of a hand crank to either engage or disengage a cover with a microplate.

In a preferred embodiment, the machine provides an enclosure having a hinged top and a latch for securing the top in a closed position. A hand crank extends from one side of the enclosure. When the latch is released and the top is open, access may be gained to an interior platform on which a microplate may be placed. If a cover is already engaged with the microplate, the top of the enclosure is closed and latched. A user rotates the crank approximately 90° from its starting position. During the first part of the crank's rotation, a set of cams engage the sides of the cover. The cams flex or bow the sides of the cover such that they spread outwardly and clear the bottom edge of the microplate. Simultaneously, the platform on which the microplate rests is lowered and the microplate descends beneath the cover. At that point, the top of the enclosure may be opened, and the disengaged cover and microplate removed.

To engage a cover with a microplate, the microplate is placed on the platform and the cover is placed in a holder which suspends the cover above the microplate. The top of the machine is closed and latched. The hand crank is rotated, again approximately 90° from its starting position, but in the opposite direction from that used to disengage the cover. This action causes the set of cams to flex the cover's sides and spread the sides apart. As the crank continues to rotate, the platform rises and brings the microplate into contact with the cover. As the crank completes its rotation, the cams release the sides of the cover, thereby allowing the sides to return to their normal positions and engage the bottom edge of the microplate.

The present invention provides a rugged, reliable, and safe approach to engaging and disengaging microplate covers. Risk of injury to a user is practically eliminated as most of the action occurs inside the enclosure away from the operator's person. The hand crank may be positioned on either side of the machine to accommodate either right or left-handed users. In addition, the direction in which the crank must be rotated to perform an engagement or disengagement may be selected by the user.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
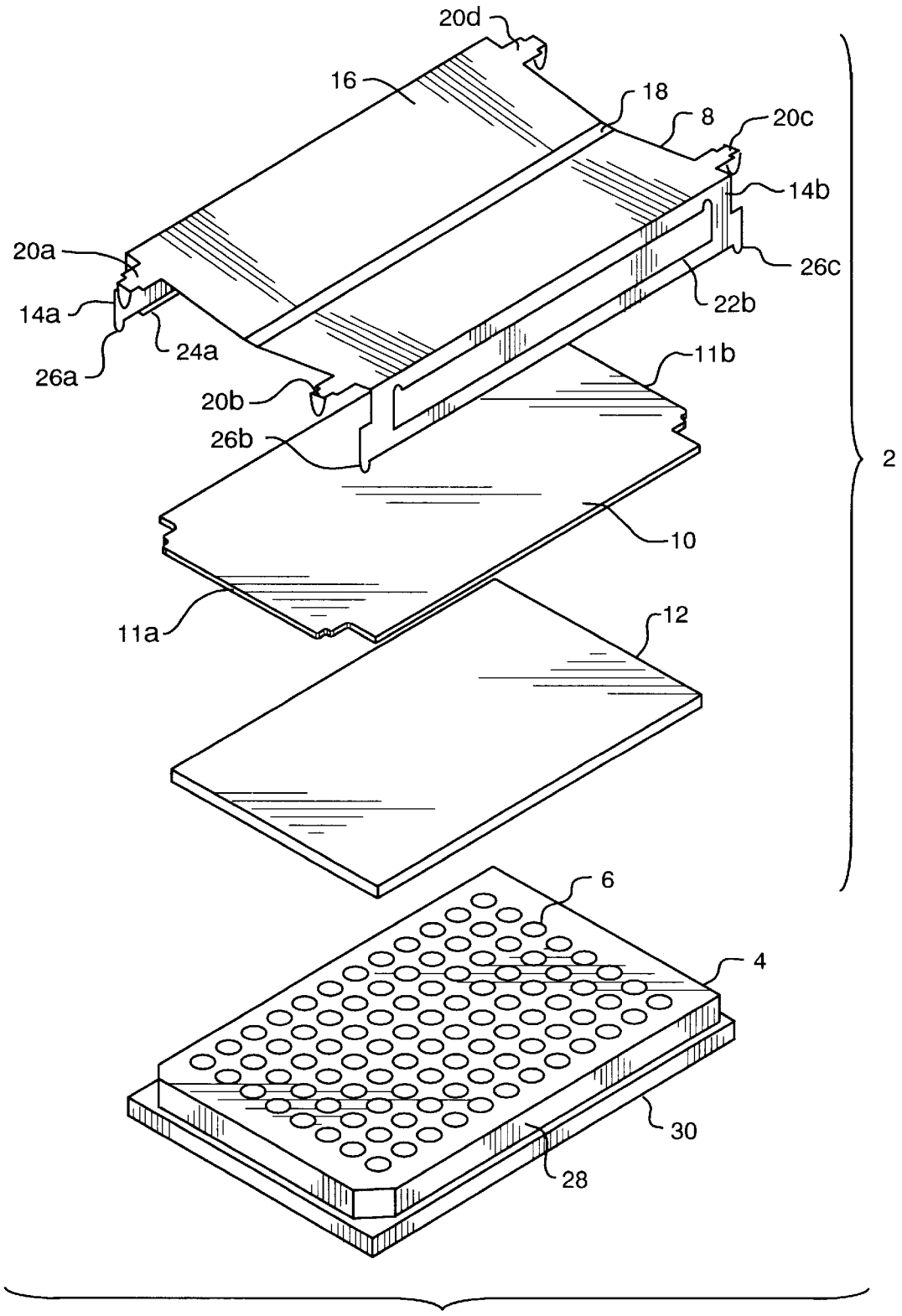
FIG. 1 is an exploded, perspective view of a microplate lid assembly.

FIG. 1 shows a microplate cover assembly 2 which may be used to seal wells 6 contained in a microplate 4. Microplate 4 is of conventional design and is available from any of a number of commercial sources in any of 24, 96 or 384 well formats, and may include others. It should be understood that the term "microplate" as used herein includes, but is not limited to, shallow well, deepwell, half deepwell and PCR type plates as well as minitube racks. It should also be understood that the present invention is not limited to any particular matrix size.

A cover 8 is disposed on a pressure plate 10. Pressure plate 10 is disposed on a layer of sealing material 12, which in turn is disposed on the top surface of microplate 4. Cover 8 includes an angled top surface 16 with a narrow, generally flat portion 18 extending laterally along the central axis of the cover. Cover 8 includes sides 14*a* and 14*b* which are generally orthogonal to top surface 16. Extending laterally from the edges of top surface 16 are tabs 20*a*–20*d* which function as gripping points for either the lidder/delidder described below or a robotic handling system (not shown).

Pressure plate 10 includes two tabs 11*a*, 11*b* which are used to properly position cover assembly 2 prior to engaging the assembly with a microplate, as described in detail below.

Each side 14*a*, 14*b* includes a generally rectangular aperture, only one of which, 22*b,* is visible in this figure. Such apertures allow side surface 28 of microplate 4 to remain visible when assembly 2 is engaged with the microplate. Thus, identifying marks or bar code labels, which are often located on side surface 28, are not obscured once microplate 4 is sealed. In addition, such apertures increase the flexibility of sides 14*a*, 14*b,* thereby reducing the force necessary to either engage or disengage cover 8 from microplate 4.

Each side 14*a*, 14*b* also includes an inwardly-extending flange, only one of which, 24*a,* is partially visible. Such flanges extend laterally for most of the lengths of sides 14*a,* 14*b* and, when cover 8 is engaged with microplate 4, support a bottom edge 30 of microplate 4, keeping the microplate from distorting and anchoring the cover to the microplate.

The bottom corner of each side 14*a,* 14*b* also includes a foot, three of which, 26*a*–26*c,* are visible in this figure. Such feet allow multiple cover assembly 2/microplate 4 units to be stacked one upon another.

Cover 8 and pressure plate 10 are preferably constructed from stainless steel or conventional spring steels with corrosion resistant plating or coatings. Layer 12 is preferably constructed from a material sold under the trademark GEON. It will be apparent to those skilled in the art that a wide variety of other suitable materials may be substituted including Techron, EVA, Neoprene, polypropylene or Teflon® films.

In a preferred embodiment, cover 8, pressure plate 10 and sealing layer 12 are joined together by a mechanical arrangement such as swaged over tabs, spot welding or riveting. Pressure plate 10 and sealing layer 12 are preferably joined with a conventional adhesive such as cyano-acrylate or pressure sensitive adhesive suitable for the material being bonded. With its components fastened together, cover assembly 2 may be more easily engaged with and disengaged from microplate 4.

Figure 2:
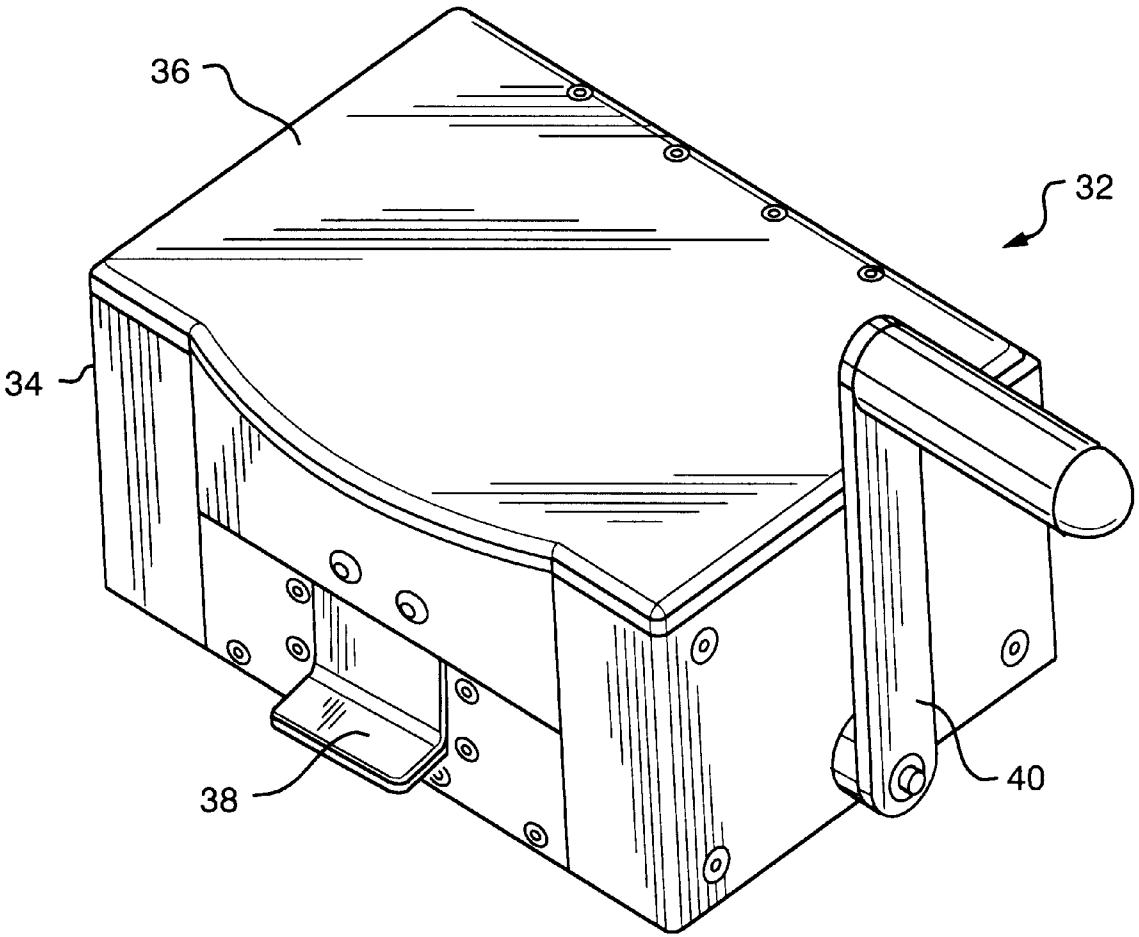
FIG. 2 is a perspective view of a machine, constructed in accordance with a preferred embodiment of the present invention, for engaging the lid assembly of FIG. 1 with or disengaging same from a microplate.

FIG. 2 shows a lidder/delidder 32, constructed in accordance with a preferred embodiment of the present invention, which may be used to manually engage or disengage cover assembly 2 from microplate 4. A generally rectangular housing 34 has a hinged top 36 which is secured by a latch 38. A hand crank 40, shown in its neutral (vertical) position, is located on the right side of housing 34 and is connected to a shaft 46. Lidder/delidder 32 is preferably constructed primarily from stainless steel, but any of a number of other materials may be used.

Figure 3:
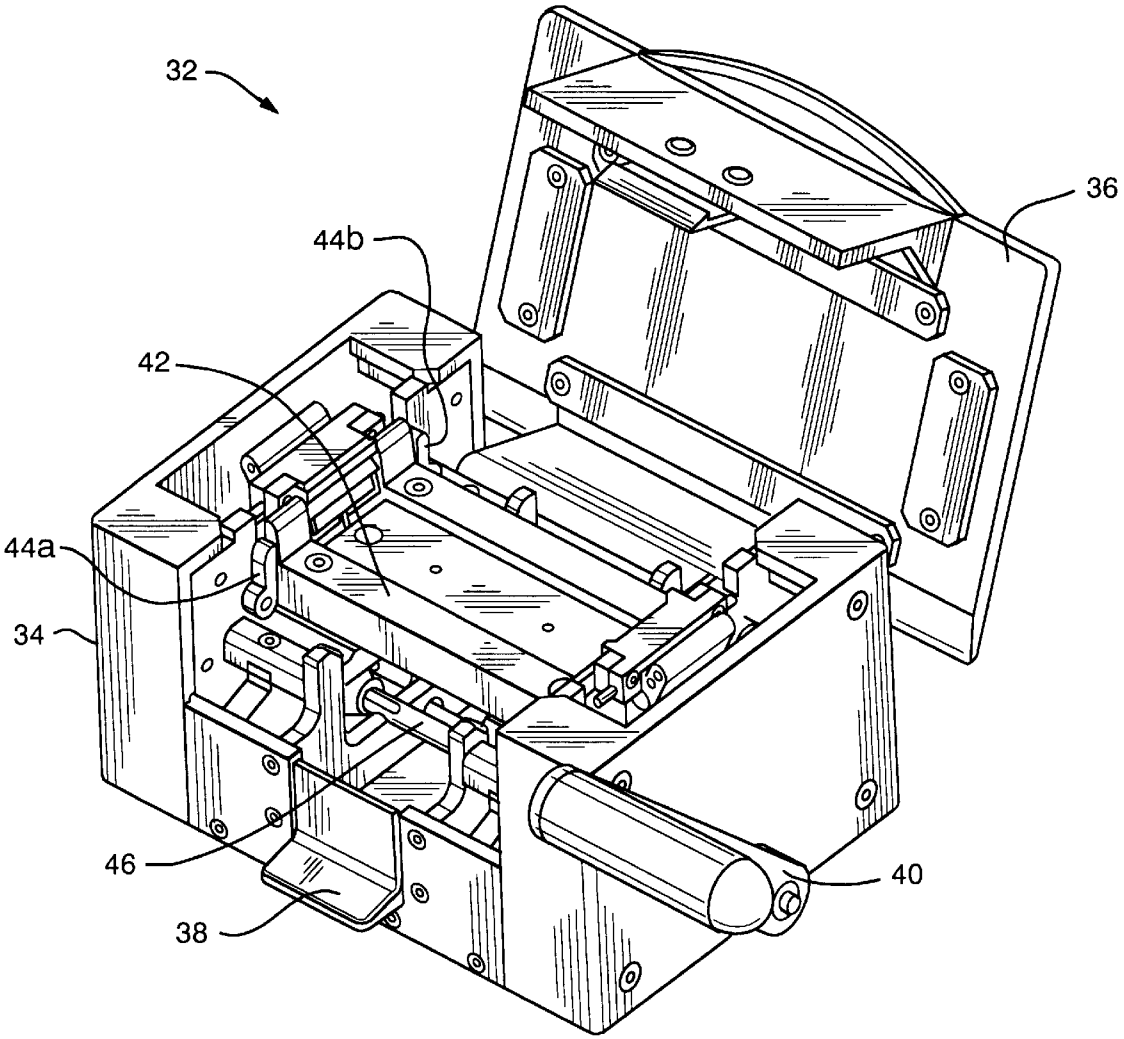
FIG. 3 is a perspective view of the machine of FIG. 2 in which the top is open.
Figure 4:
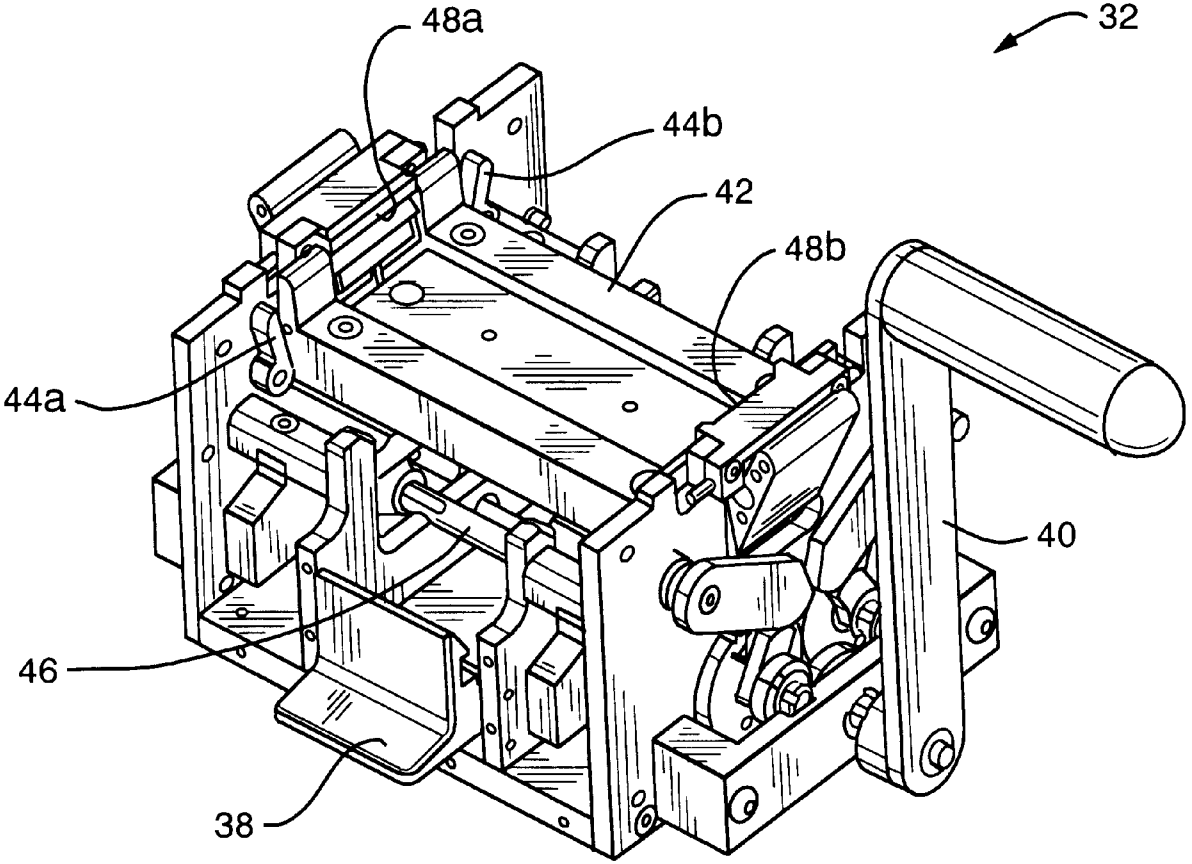
FIG. 4 is a perspective view of the machine of FIG. 2 with the enclosure panels removed to reveal the internal construction.

As may be seen more clearly in FIGS. 3 and 4, when latch 38 is released, top 36 opens, thereby enabling a user to gain access to the interior of housing 34. Two recesses, 48*a,* 48*b,* are shaped and dimensioned to receive tabs 11*a,* 11*b* (FIG. 1) of pressure plate 10. Thus, when a free (unengaged) cover assembly 2 is placed into lidder/delidder 32, the assembly 2 will rest on recesses 48*a,* 48*b.*

A movable platform 42 is shaped and dimensioned to support a microplate (omitted for clarity), like microplate 4 (FIG. 1), to which a cover may or may not already be engaged. Four cams, only two of which, 44*a,* 44*b,* are visible in this figure, are disposed proximate to each corner of platform 42, respectively. Platform 42 and cams 44 are mechanically coupled to hand crank 40.

Figure 5:
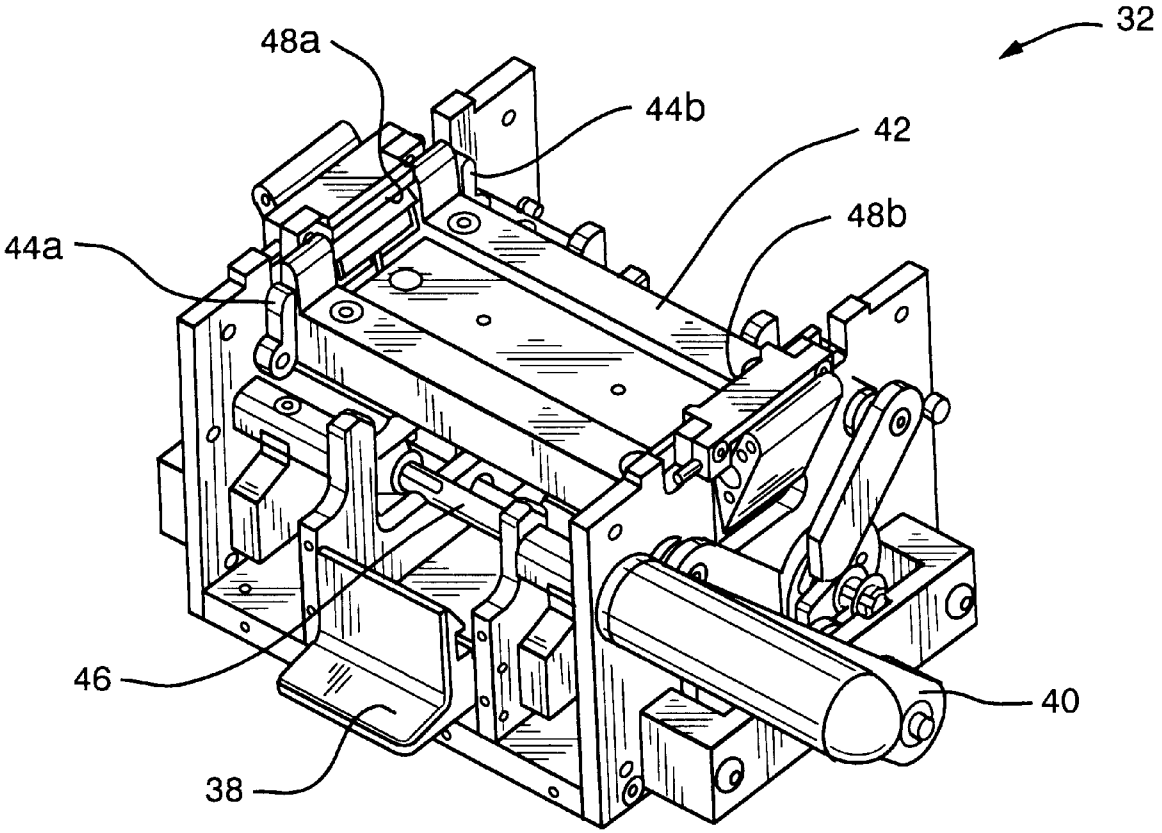
FIG. 5 is a perspective view of the machine of FIG. 4 showing the crank in a position to begin a disengagement of a microplate cover.
Figure 6:
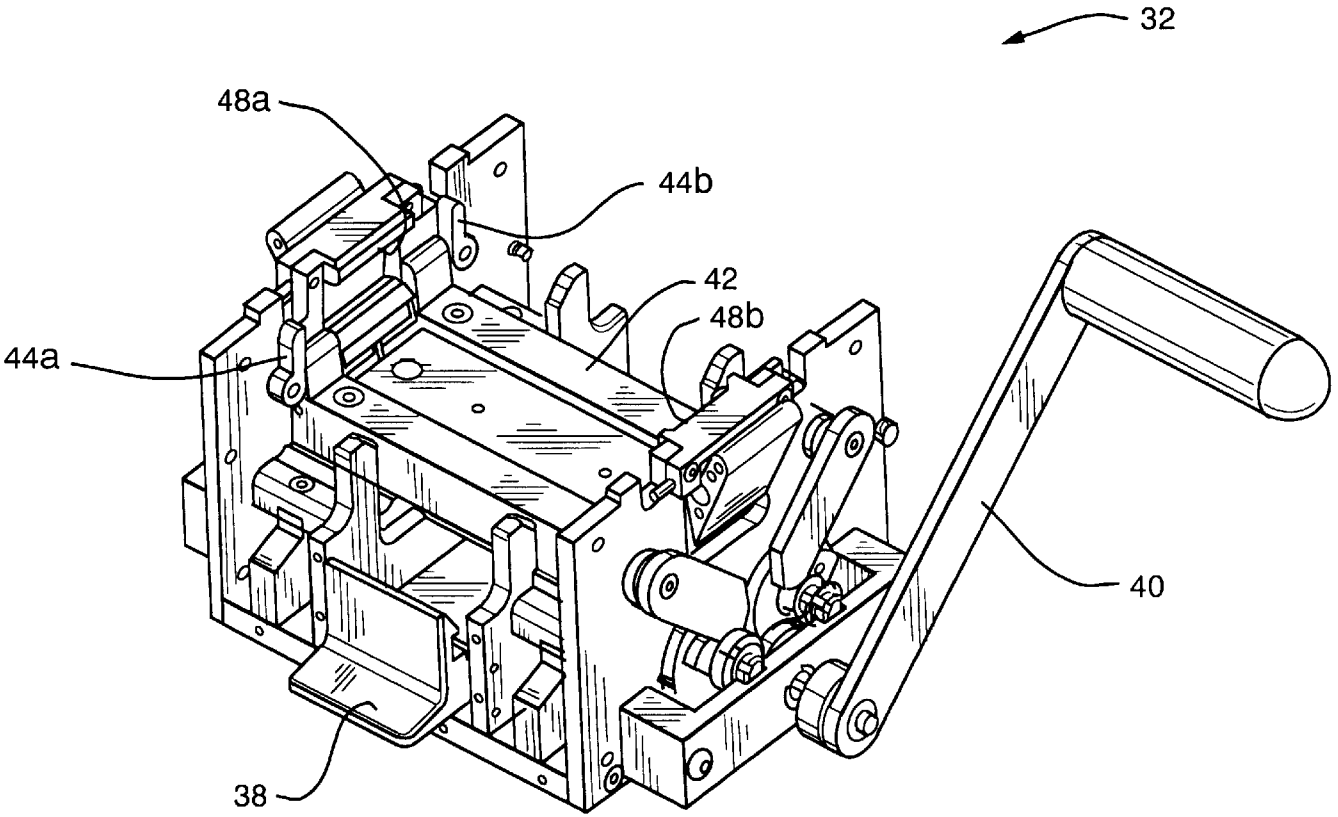
FIG. 6 is a perspective view of the machine of FIG. 4 showing the crank in a position to being an engagement of a microplate cover.

With reference to FIGS. 1 and 4–6, the operation of lidder/delidder 32 will now be described. Let us assume that a user wishes to engage a cover with a microplate. As shown in FIG. 6, when hand crank 40 has been rotated clockwise to its maximum position platform 42 is lowered by several inches from its highest position. This is the normal starting position for engaging a cover with a microplate. A cover assembly 2 is then placed above the microplate and supported in that position by tabs 11*a,* 11*b* resting on recesses 48*a,* 48*b,* respectively. The user closes top 36, thereby engaging latch 38.

Next, the user rotates hand crank 40 in a counterclockwise direction (i.e., pulling the handle of the crank toward the user). As hand crank 40 rotates, it turns shaft 46 which causes several actions. First, cams 44 begin to rotate and cause the sides 14*a,* 14*b* of cover 8 to flex outwardly. As hand crank 40 continues to rotate, platform 42 begins to lift and eventually brings the top surface of microplate 4 in contact with sealing material 12. At that point, cams 44 begin to rotate in the opposite direction, slowly allowing sides 14*a,* 14*b* to return to their original positions. As sides 14*a,* 14*b* return to their original positions, flanges 24*a* and 24*b* move under the bottom surface 30 of microplate 4, thus securing cover assembly 2 to the microplate.

Now, consider the example of disengaging a cover from a microplate. As shown in FIG. 5, the hand crank 40 has been rotated counterclockwise to its maximum position. This is the normal starting position for disengaging a cover from a microplate. Platform 42 is at its maximum height. A microplate 4, with engaged cover assembly 2, is placed on platform 42. The user then closes top 36 of the lidder/delidder 32. As the user begins to rotate crank 40 in a clockwise direction (i.e., away from the user), cams 44 begin to rotate and force sides 14*a*, 14*b* of cover 8 to flex outwardly. Platform 42 then begins to descend, causing microplate 4 to drop below and clear of cover 8. As crank 40 completes its clockwise rotation, cams 44 slowly release sides 14*a*, 14*b*, which return to their original positions.

Figure 7:
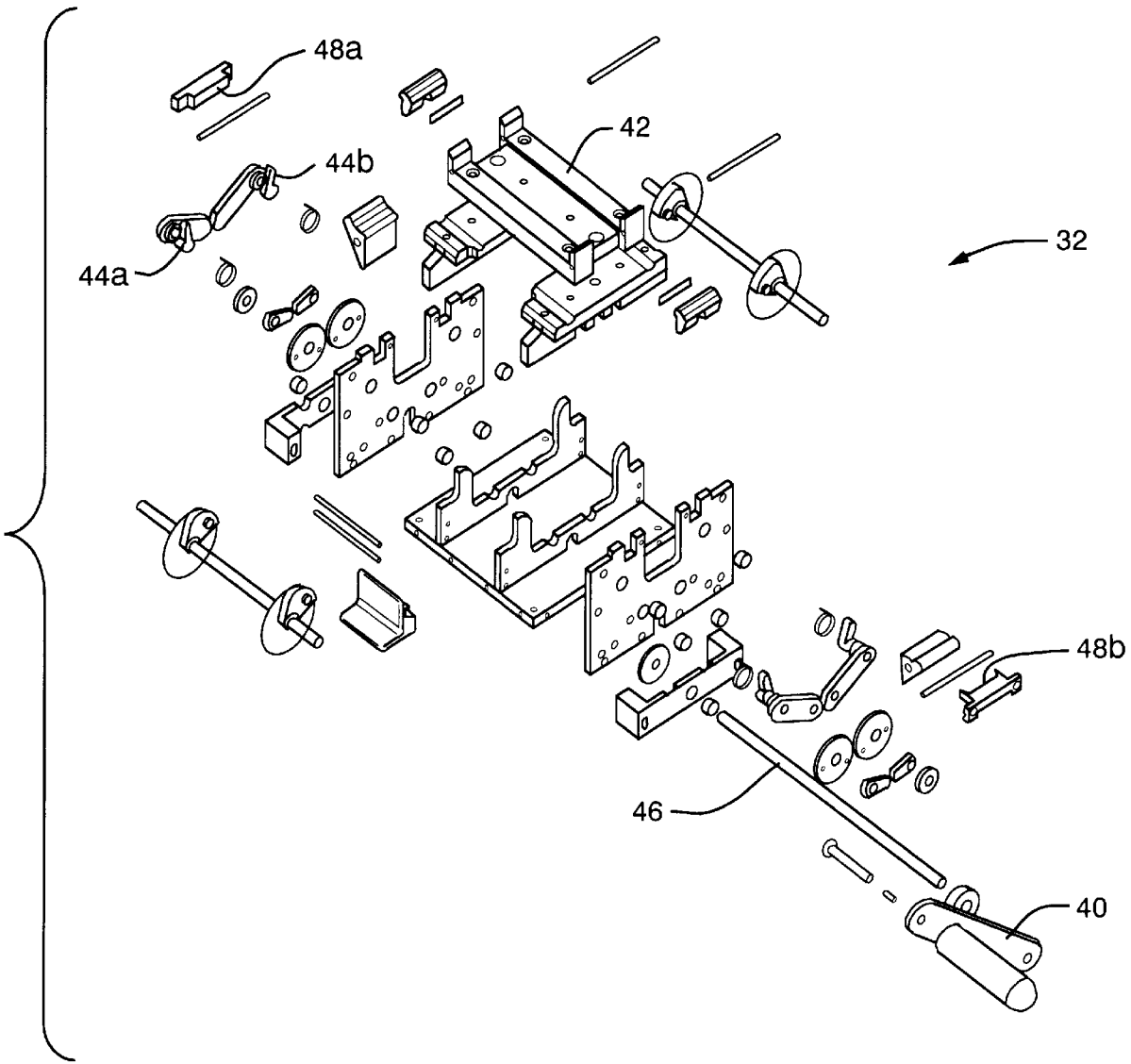
FIG. 7 is an assembly drawing of the machine of FIG. 4

As shown in FIG. 7, an assembly drawing of lidder/delidder 32, hand crank 40 may be attached to either side of lidder/delidder 32 to accommodate either right or left-handed users. In addition, the actions induced by crank 40 may be reversed from those described above, such that the user may choose in which direction of crank rotation a cover engagement or disengagement procedure is carried out.

Those skilled in the art will recognize that while a preferred embodiment of the invention described above relies on a hand crank, other manually operated devices could be substituted for the crank. In addition, a motor or other drive could be used to partially or fully power the operation of the lidder/delidder.

What is claimed is:

1. Apparatus for engaging a cover assembly with or disengaging the assembly from a microplate, the cover assembly comprising;

a cover having top and side walls, the sidewalls extending down from the top and including inwardly extending projections that engage the bottom surface of a microplate, the top extending upwardly from a longitudinally extending center area, thereby exerting a spring force downwardly along the central area when the projections engage the bottom surface of the microplate;

a rigid pressure plate disposed beneath the cover;

a gasket disposed between the pressure plate and the microplate when the cover assembly is installed on the microplate, whereby the downward force exerted by the cover is applied by the pressure plate to the gasket;

first and second pressure plate tabs extending longitudinally from opposite ends of the pressure plate; and a plurality of sidewall tabs generally coplanar with the sidewalls and extending therefrom;

said apparatus comprising:

a housing:

a platform disposed in said housing and having an upper surface for supporting a microplate, said platform being vertically movable;

means forming recesses, fixed with respect to said housing and positioned to receive said pressure plate tabs and thereby position said cover assembly within said housing;

a plurality of cams positioned inwardly of said sidewall tabs;

a hand operated actuator mechanically connected to said platform and said sidewall tabs such that (a) movement of said actuator in a first direction moves said sidewall tabs outwardly to release the sidewall projections from said microplate and further movement in the same direction moves the platform downwardly to separate the microplate from the cover assembly; and (b) movement of said actuator in the opposite direction moves said platform upwardly, thereby to bring a microplate disposed on said platform into contact with a cover assembly positioned by said recesses, and further movement in the same direction moves said cams inwardly to permit said sidewalls to move inwardly and bring said projections into position beneath the bottom surface of said microplate.

* * * * *